US006739444B2

(12) United States Patent
Baker et al.

(10) Patent No.: US 6,739,444 B2
(45) Date of Patent: May 25, 2004

(54) INDUCTIVE COIN SENSOR WITH POSITION CORRECTION

(76) Inventors: Kevin R. Baker, 3015 Fieldview Dr., Murfreesboro, TN (US) 37128; Kent Erickson, 52 Locksley Rd., Glen Mills, PA (US) 19342

( * ) Notice: Subject to any disclaimer, the term of this patent is extended or adjusted under 35 U.S.C. 154(b) by 109 days.

(21) Appl. No.: 10/077,047

(22) Filed: Feb. 14, 2002

(65) Prior Publication Data

US 2002/0144877 A1 Oct. 10, 2002

Related U.S. Application Data

(60) Provisional application No. 60/270,040, filed on Feb. 20, 2001.

(51) Int. Cl.[7] ..... G07D 5/08; G07D 5/02

(52) U.S. Cl. ..... 194/318; 317/334; 324/243; 324/228

(58) Field of Search ..... 194/318, 219, 194/302, 303, 317, 328, 324, 335; 324/228, 229, 234, 236, 243

(56) References Cited

U.S. PATENT DOCUMENTS

| | | | | |
|---|---|---|---|---|
| 4,108,296 A | | 8/1978 | Hayashi et al. | |
| 4,416,365 A | | 11/1983 | Heiman | |
| 4,742,903 A | | 5/1988 | Trummer | |
| 4,754,862 A | | 7/1988 | Rawicz-Szczerbo et al. | |
| 4,846,332 A | | 7/1989 | Quinlan | |
| 4,951,799 A | * | 8/1990 | Kai | 194/317 |
| 5,158,166 A | * | 10/1992 | Barson | 194/319 |
| 5,180,046 A | | 1/1993 | Hutton et al. | |
| 5,236,071 A | * | 8/1993 | Lee | 194/200 |
| 5,263,566 A | * | 11/1993 | Nara et al. | 194/318 |
| 5,293,980 A | | 3/1994 | Parker | |
| 5,379,876 A | | 1/1995 | Hutton | |
| 5,439,089 A | | 8/1995 | Parker | |
| 5,489,015 A | | 2/1996 | Wood | |
| 5,568,854 A | | 10/1996 | Hayes et al. | |
| 5,687,830 A | | 11/1997 | Hayes et al. | |
| 5,871,075 A | | 2/1999 | Takayama et al. | |
| 5,988,348 A | | 11/1999 | Martin et al. | |
| 6,125,987 A | * | 10/2000 | Abe et al. | 194/213 |
| 6,288,538 B1 | * | 9/2001 | Aruga et al. | 324/232 |
| 6,340,082 B1 | * | 1/2002 | House et al. | 194/317 |

FOREIGN PATENT DOCUMENTS

| | | | | |
|---|---|---|---|---|
| GB | 2.086.633 A | * | 5/1982 | G07F/3/04 |
| WO | WO 98/37522 | | 8/1998 | |

* cited by examiner

*Primary Examiner*—Donald P. Walsh
*Assistant Examiner*—Mark J Beauchaine

(57) ABSTRACT

A coin sensor utilizes time-multiplexing of LC oscillators having natural frequencies F1A, F1B, F2, and F3 to produce magnetic fields in three sets of windings. As a coin passes through the coin sensor, the LC oscillators are separately enabled in a sequence to produce a frequency profile for each set of windings. A first winding produces a frequency profile for the facial area of a coin, a second winding produces a frequency profile for a cross-sectional area of a the coin, and a third winding produces a frequency profile for further distinguishing the relative size of a coin. A microcontroller identifies signature points from the frequency profiles and compares the signature points with stored signatures for a multitude of coins and/or tokens.

21 Claims, 4 Drawing Sheets

INDUCTIVE COIN SENSOR WITH POSITION CORRECTION

CROSS-REFERENCES TO RELATED APPLICATIONS

This application claims the benefit of priority of U.S. provisional application Ser. No. 60/270,040 filed Feb. 20, 2001 which is incorporated herein by reference in its entirety.

FIELD OF THE INVENTION

The present invention relates generally to coin sensors and more specifically to inductive coin sensors for identifying a variety of coins.

BACKGROUND OF THE INVENTION

Coin operated machines must have the capability of determining the validity of an inserted coin or token as well as its value. A typical coin sensor utilizes inductive electromagnetic fields created by energized sensor windings to sense coins. A coin inserted into a coin slot of the coin sensor travels through an electromagnetic field causing field variations as it travels. Characteristics of observed frequency and amplitude changes of the oscillating electrical signals caused by the field variations are compared with stored expected values for a variety of coins. If the characteristics of the inserted coin are not within the predetermined recognizable limits of the stored expected values, then the coin is not accepted and returned to the patron. For example, coins are often worn or otherwise damaged due to use which results in unrecognizable characteristics.

The prior art method of coin detection often leads to frustration for the patron since, more often than not, worn and/or damaged coins are rejected because the coins display characteristics outside of the acceptable limits. The determined patron struggles with a particular sensor, often without success, by feeding the same coin into the sensor over and over again. In applications such as vending machines for transit fares, an improperly-functioning vending machine not only damages the business reputation of the responsible transit authority, but may cause a patron to miss a transit connection.

The prior art coin sensors also present other inconveniences and shortcomings. The arrangement of the windings of the prior art often necessitate the feeding of a single coin through the sensor area before another coin can be accepted for verification. Another problem faced by the prior art coin sensors is the necessity for calibration due to the aging of the coin detection device and temperature and humidity variations. Proposed calibration techniques include storing a range of values for each coin to compensate for the calibration variations. Another technique employs a reference oscillator to generate correcting signals for use by the sensor circuitry. Still another technique employs introducing a calibration signal into the windings to produce a response that is then used to calibrate the responses due to actual coins. These solutions add complexity to the sensor circuit and cannot compensate for all variations that may occur during operation of the coin sensor.

A number of coin sensor configurations have been proposed to overcome the deficiencies of the basic inductive sensor including the use of a number of fields with different frequencies to measure more than one characteristic of the coin. Another configuration utilizes the change in amplitude of a field over time to identify a particular coin. Although a number of comparison factors may increase accuracy, the coin sensor maintains the problems of inaccuracies due to calibration and the positioning of the coin as it passes through the sensor. Thus, the need remains for an efficient and accurate coin sensor.

SUMMARY OF THE INVENTION

It is an advantage of the present invention to provide a component-efficient sensor that minimizes the need for complex circuitry.

It is another advantage to provide a sensor that minimizes the detrimental effects of the lateral, longitudinal, and transverse positioning of a coin through a sensor.

Yet another advantage of the present invention is to provide a coin sensor that is not affected by changes in oscillator frequency due to long term drift caused by component aging and environmental changes.

Still another advantage is to provide a coin sensor that does not require control of coin velocity nor control of the lateral, longitudinal or transverse position of the coin.

It is a further advantage to provide a coin sensor with a plurality of oscillators that are time-division multiplexed to prevent interaction between the oscillators in order to obtain accurate frequency profiles, and to minimize circuit complexity and product size.

Further advantages and objects of the present invention will be apparent from the following description of the invention.

In an exemplary embodiment, a coin is introduced into a coin slot of a coin sensor and travels through the magnetic fields of three sets of windings before exiting the coin sensor. The magnetic fields are produced by four inductive/capacitive (LC) oscillators. A first set of windings, corresponding to a first pair of oscillators, is split into two halves, one half in an upper portion of the coin sensor, i.e., above the coin slot, and the other half in a lower portion of the coin sensor, i.e., below the coin slot. The first set of windings is oriented to generate magnetic flux lines perpendicular to the faces of the coin in the coin slot. As the coin travels through the magnetic field of the first set of windings, the inductance of the oscillator drops, causing a rise in the frequencies F1A and F1B of the first pair of oscillators, wherein the rise in frequencies F1A and F1B is due primarily to the facial area of the coin.

The coin sensor of the exemplary embodiment further includes a second set of windings corresponding to a third oscillator. The second set of windings surrounds the coin slot in such a way as to generate magnetic flux lines that are parallel to the faces of the coin as it travels through the coin slot. The presence of the coin in the magnetic field causes a drop in the inductance of the third oscillator, resulting in a rise in frequency F2 of the oscillator. The rise in frequency F2 is due to the cross-sectional area, i.e., the thickness multiplied by the diameter, of that portion of the coin within the field. A third set of windings, driven by a fourth oscillator, is split in two half-coils that are separated longitudinally in the direction of coin motion. The third set of windings produces two magnetic fields that are perpendicular to the faces of the coin as it travels through the coin slot. The two half-coils of the third set of windings are utilized to further distinguish the relative size of an inserted coin. Particular coin sizes may interact more strongly when both half-coils cover portions of the coin, while other coin sizes may interact more strongly when a single half-coil covers a portion of the coin.

The four oscillators of the exemplary embodiment are operated in a time-division multiplex fashion utilizing control lines controlled by a microcontroller. The time-division multiplexing allows all frequencies of the three sets of windings to be measured by a single counter. In addition, time-division multiplexing ensures that the magnetic fields of the windings do not interact, thus providing predictable frequency changes for a particular valid coin type. The frequencies of the four oscillators are counted utilizing a counter that is multiplexed to the outputs of the oscillators in a predetermined sequence and for a pre-determined duration. The microcontroller accumulates samples of each of the frequencies from the counter and stores the results in a memory. The samples of the frequencies are then utilized by the microcontroller to produce three frequency profiles for the inserted coin, wherein the first frequency profile corresponds to the first set of windings, the second frequency profile corresponds to the second set of windings, and the third frequency profile corresponds to the third set of windings.

Specific points of the frequency profiles are extracted to identify the inserted coin. In the exemplary embodiment, a frequency point of each of the three frequency profiles is identified for the coin when it is centered in the coin slot. After compensation for transverse position, these three points are used directly as the signature for the inserted coin, and are sufficient for the identification of most coins. However, the method of the exemplary embodiment may identify other points, such as cross-over points where one frequency profile crosses another, to further define a signature. Once the microcontroller has determined a signature for the inserted coin, it compares the signature to pre-stored signatures for a variety of valid coins and/or tokens. If a match is found for all points of the signature, then the inserted coin is identifiable for further processing, e.g., for acceptance or rejection based upon the particular requirements of the mechanism utilizing the coin sensor.

BRIEF DESCRIPTION OF THE DRAWINGS

The present invention will be better understood from the following detailed description of a first embodiment of the invention, taken in conjunction with the accompanying drawings in which like reference numerals refer to like parts and in which.

DESCRIPTION OF THE PREFERRED EMBODIMENT

The natural frequency of an inductive/capacitive (LC) oscillator is given by:

$$F = \frac{1}{2\pi\sqrt{(LC)}} \qquad \text{Equation 1}$$

where:

F is the natural frequency;

L is the inductance; and

C is the equivalent series capacitance.

When conductive material is introduced into the AC (or pulsed DC) magnetic field of an inductive/capacitive (LC) oscillator, eddy currents induced in the conductive material by the driving field create an AC magnetic field of their own which opposes the driving field. This opposition reduces the effective inductance L of the oscillator circuit, and the oscillator frequency rises. The percentage drop in inductance L is generally proportional to the magnetic flux which originally penetrated the volume subsequently occupied by the conductive material. In an inductive coin sensor, the passage of a coin or token through a set of windings causes the corresponding oscillator frequencies to rise and fall in profiles that are characteristic of that particular coin and that set of windings. From these profiles certain "signatures" are extracted to identify the coin.

Figure 4:
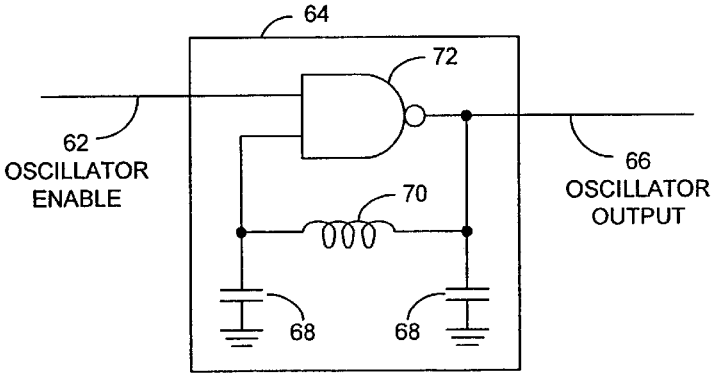
FIG. 4 is a circuit diagram of an inductive/capacitive (LC) oscillator of a preferred embodiment.
Figure 7:
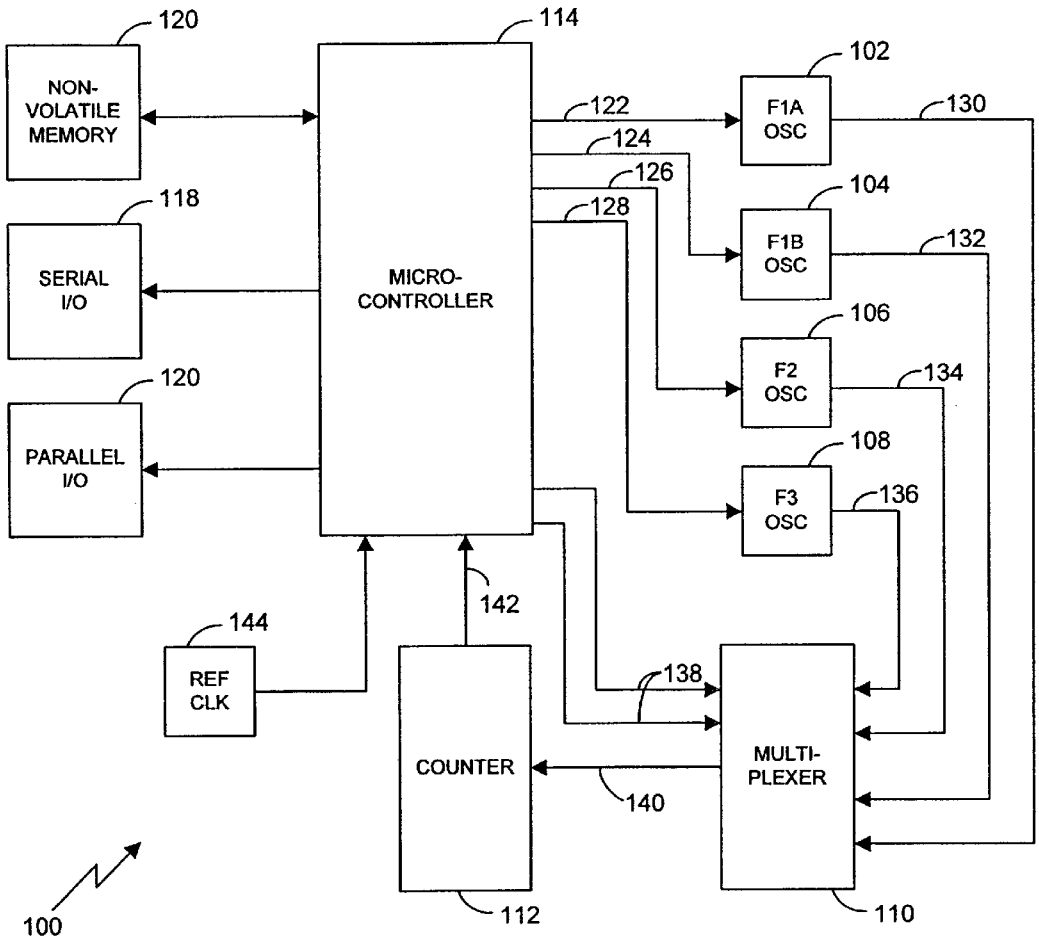
FIG. 7 is a block diagram of sensor electronics used to control, multiplex and sample the oscillator frequencies of a preferred embodiment.

There are many types of inductive/capacitive (LC) oscillators but they generally share the characteristic that their frequencies are proportional to √L. Therefore, the type of oscillator employed has little effect on the sensitivity with respect to the inductance. The simplest type of LC oscillator 64 is shown in FIG. 4, and is utilized in the preferred embodiment of the present invention. The oscillator 64 includes capacitors 68 and inductor or coil windings 70 that produce a desired natural frequency F. The oscillator output 66 is enabled by control element 72 that is driven by an oscillator enable 62 line. The coin sensor of the preferred embodiment utilizes four LC oscillators 102, 104, 106, 108, as shown in FIG. 7, for a first, a second, and a third set of windings as discussed below.

Figure 1:
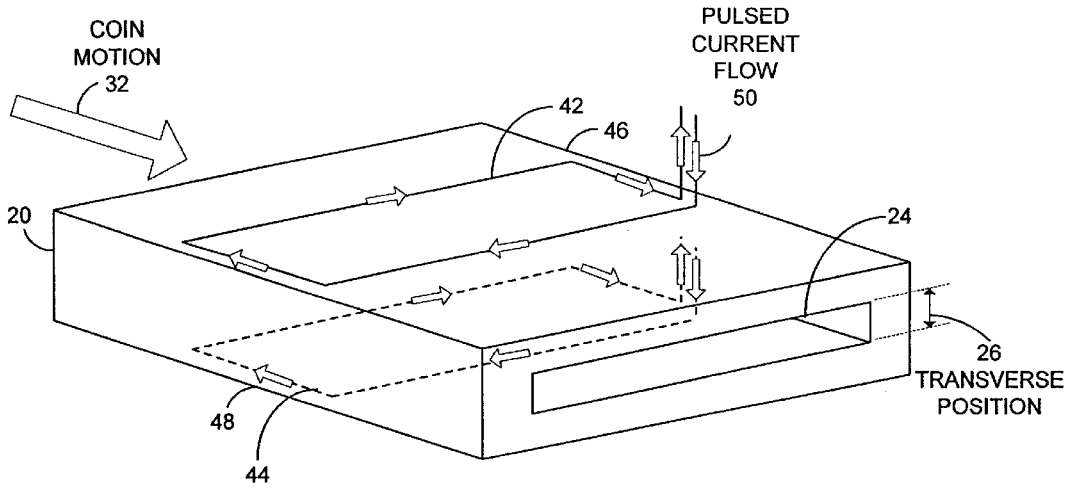
FIG. 1 is an illustration of a first winding for generating flux lines perpendicular to the faces of coins.

Referring to FIG. 1, a coin sensor 20 of the preferred embodiment accepts a coin into a coin slot 24 such that the coin travels through the coin sensor 20 in the direction of the indicated coin motion 32. A first set of windings 42, 44 is oriented as shown to generate magnetic flux lines predominantly perpendicular to the faces of the coin. The drop in inductance L of the first set of windings 42, 44, and hence the rise in frequency F, is due primarily to the facial area of the coin, which is normal to the flux lines.

While the present sensor attempts to strike a compromise between sensitivity and spread in frequency readings due to differences in transverse positioning 26 of a coin, it is desirable to remove any fluctuation in samples due to variations in the transverse position 26 of the coin. Such variations in transverse position 26 cause a corresponding rise or fall in frequency due to differing proximity of the coin to a winding. As shown in FIG. 1, in the preferred embodiment of the present invention, the first set of windings 42, 44 is split into two halves, one half in an upper portion 46 of the coin sensor 20 and the other half in a lower portion 48 of the coin sensor 20, wherein the first portion of windings 42 and the second portion of windings 44 are driven by separate oscillators 102, 104, as shown in FIG. 7. The samples for these two discrete oscillators 102, 104 are summed to provide a combined sample that is equivalent to the sample that would be obtained from a combination winding of an alternate embodiment that utilizes a single oscillator. The difference between sample values from the two oscillators 102, 104 of the preferred embodiment provides an indication of transverse coin position 26 within the coin slot 24. The transverse coin position 26 is utilized to calculate a compensation factor which is used to compensate the summed sample for position, effectively normalizing the transverse coin position 26 to the center position. This compensation factor may be suitably scaled to further normalize the frequency profiles produced by the other sets of windings 38, 52 of FIGS. 2 and 3, respectively.

The compensation factor does not address pitch or roll of the coin, which also alters the frequency profiles. Through the use of appropriate software routines, the longitudinal pitch of the coin may be determined by examining the temporal separation between peaks on the separate windings of the F1 pair, and thereby compensated. However, in practice, the variations in frequency profiles due to pitch or roll of the coin are deemed to be within acceptable limits.

Figure 2:
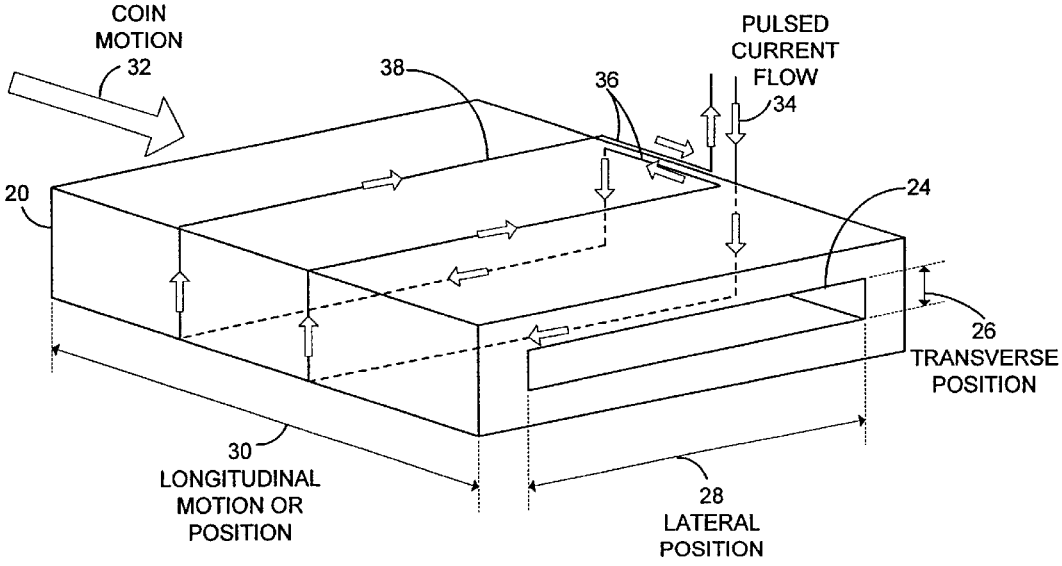
FIG. 2 is an illustration of a second winding for generating flux lines parallel to the faces of coins.

FIG. 2 illustrates a second set of windings 38 that is oriented so as to generate magnetic flux lines predominately parallel to the faces of the coin. As a coin travels through the sensor coin slot 24, the inductance L of the second winding 38 drops. The resulting rise in frequency F is due primarily to the cross-sectional area (thickness x diameter) of that portion of the coin within the field, the cross-sectional area being normal to the flux lines of the second winding 38 as it travels through the coin slot 24. The current flow 34 and cross over paths 36 of the second set of windings 38 are shown for illustrative purposes only and may be configured in any way that provides magnetic flux lines parallel to the faces of a coin in coin slot 24.

Figure 3A:
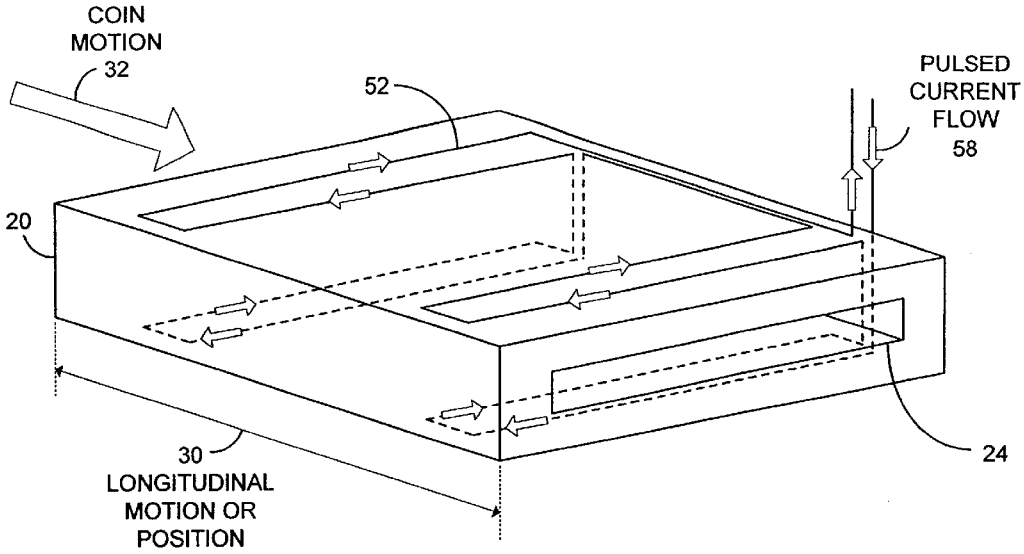
FIG. 3*a* is an perspective view of a third winding comprising two half-windings separated longitudinally.
Figure 3B:
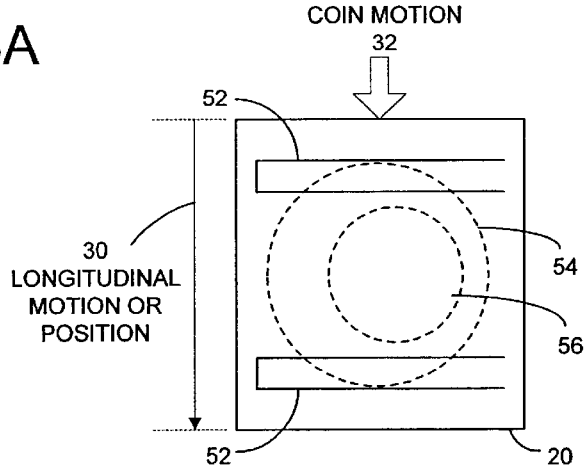
FIG. 3*b* is a top view of the third winding of FIG. 3*a* illustrating a positioning of a large and small coin.

FIG. 3*a* illustrates a third set of windings 52 of the coin sensor 20 of a preferred embodiment. The third set of windings 52 comprises two half-coils that are separated longitudinally 30, i.e., in the direction of coin motion 32. The two half-coils 52 produce two magnetic fields that are perpendicular to the faces of a coin. As illustrated in FIG. 3*b*, the two half coils 52 are positioned so that particular coin sizes interact more strongly with the magnetic fields produced by the half coils 52 when both half coils 52 cover portions of the coin, while other coin sizes interact more strongly when only one of the half coils 52 covers a portion of the coin. Thus, a frequency profile for a small coin 56 will differ from the frequency profile for a large coin 54. In other embodiments of the present invention, the current flow 58 through the windings and connection of the half coils 52 may be varied as desired, or as mandated by the physical construction of the windings, to provide the longitudinally separated magnetic fields. Further, other embodiments of the present invention may exhibit differences in longitudinal separation of the half coils 52 in order to provide additional information.

It is clear from the above discussion that there are multitudinous possibilities for the geometry of these inductors, i.e., the first, second and third set of windings 42, 44, 38, 52, respectively. The desired geometries are subject to the limitation that if the windings 42, 44, 38, 52 are too close to the coin slot 24, the frequency profiles become unduly sensitive to the transverse position 26 of the coin within the coin slot 24. Conversely, if the windings 42, 44, 38, 52 are too far removed from the coin slot 24, then the overall sensitivity to a given coin will be adversely affected.

Referring to FIG. 2, the position of a coin in the coin slot 24, i.e., the longitudinal position 30, the lateral position 28, and the transverse position 26, has some effect on the frequencies of oscillators 102, 104, 106, 108. However, it is undesirable to control the position of a coin in any of these axes, since any implementation of such control would require mechanical means which would be subject to wear and/or failure. In addition, mechanical means for controlling positioning of a coin require some degree of preventive maintenance as well as the repeated use of consumables which will raise the cost of ownership of the coin sensor 20 through recurring costs. Such positional control would also serve to slow down processing and limit the number of coins which may be processed in a timely manner. In fact, changes in longitudinal position 30 are both desirable and necessary in order to place the passing coin into a repository, and to observe frequency changes.

Thus, to minimize any detrimental effects due to lateral coin position within the coin slot 24, it is necessary to present a uniform set of sensing lines, i.e., windings 42, 44, 38, 52, across the sensor. Any feed-through connectors, trace turns or other routing means (not shown) are placed to either side of the coin slot 24, and are located as remotely as possible away from the coin slot 24. If, at any time, a "crossover" path 36 is needed to route the traces between separated portions of any given set of windings 38, 42, 44, 52, the crossover paths 36 are run one atop another so as to cancel any inductive effects.

FIG. 7 is a block diagram of sensor electronics 100 used to control, multiplex and sample the oscillator frequencies of a preferred embodiment of the present invention. Oscillators F1A 102 and F1B 104 correspond to the first set of windings 42 and 44, and oscillators F2 106 and F3 108 correspond to the second and third set of windings 38, 52, respectfully. In principle, all of the oscillators 102, 104, 106, 108 may be operated concurrently. However, in the preferred embodiment of the present invention, the oscillators 102, 104, 106, 108 are operated in a time-division multiplex fashion utilizing control lines 122, 124, 126, 128 controlled by microcontroller 114. Time-division multiplexing presents advantages over simultaneous operation of the oscillators. A first advantage is that all frequencies, F1A, F1B, F2, F3 may be measured with a single counter 112, thus reducing circuit complexity, cost, and product size. A second advantage to time-division multiplexing is that there is no possibility of interaction between the oscillators 102, 104, 106, 108.

Continuing with FIG. 7, the frequencies of the oscillators 102, 104, 106, 108 are counted utilizing a counter 112. The microcontroller 114 sends the appropriate enable signals 138 to the multiplexer 110 to select the presently-enabled oscillator 102, 104, 106, 108 for the output line 140 to the counter 112. The microcontroller 114 accumulates samples from the four frequencies, F1A, F1B, F2, and F3, of LC oscillators 102, 104, 106, 108 in a sequential manner. Each sample has a time slot assigned to it which is configurable based upon the oscillator frequencies and coil geometry. The time slot is determined by suitable software programming in conjunction with hardware features of the microcontroller 114 and the reference clock 144. At the end of each time slot, the microcontroller 114 reads the counter 112, disables the currently-enabled oscillator, enables the next oscillator, resets the counter 112, and sets the length of the time slot during which the counting is enabled. The microcontroller 114 is then free to process the sample while the hardware counter 112 is accumulating data.

In the present invention, a long term phenomenon of thermal drift of the oscillators does not effect the operation of the coin sensor 20 since the coin sensor 20 senses a short term phenomenon of the changes in frequency due to the passage of a coin through the coin slot 24. The natural or "idling" frequency of each oscillator 102, 104, 106, 108 is continuously monitored by the microcontroller 114 when coins are not present. The monitored frequency is then used as a reference for calculation of frequency profiles. Any frequency drift due to component aging, power supply sensitivity or thermal effects is therefore nullified.

Referring again to FIGS. 3, 4 and 7, while it is possible to manufacture the inductor windings 70 of the oscillators 102, 104, 106, 108 using discrete magnet wire, the present coin sensor 20 implements the inductor windings using traces on a pair of matched, complementary printed-circuit boards that are placed on opposing sides of the coin slot 24. These boards are assembled together and form the necessary inductors 70 for a plurality of oscillators 64. Not only does this allow for ease of manufacturing, and therefore, cost savings, but also insures excellent consistency across multiple production lots. Also, although the basic geometry of windings 42, 44, 38, 52 are shown in FIGS. 1, 2, and 3, there are numerous options available in the parameters of these windings 42, 44, 38, 52, such as width of the printed circuit traces, distance between traces, number of turns and distance between the respective windings 42,44, 38, 52.

Figure 5:
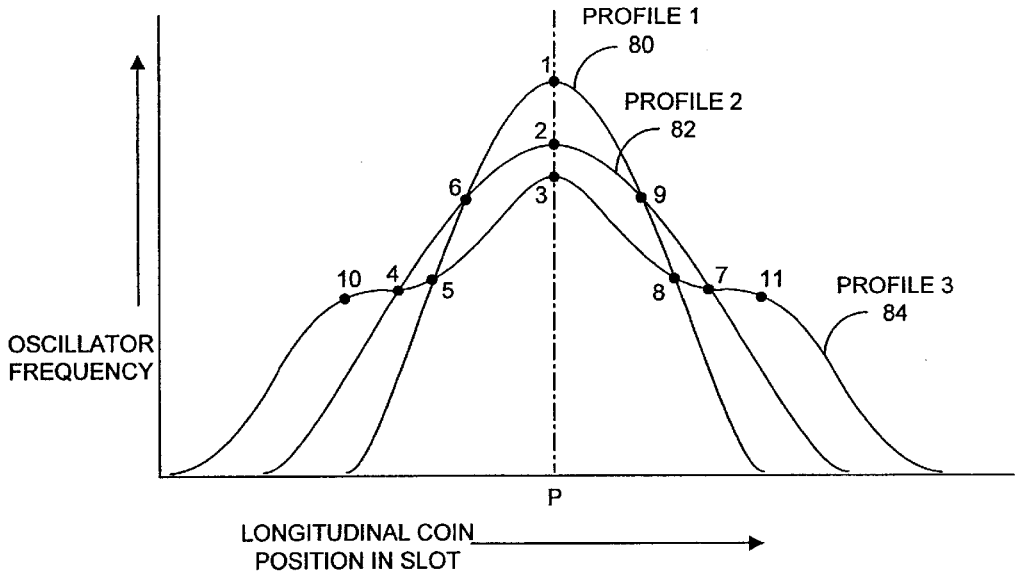
FIG. 5 shows a typical frequency profile of a large coin.
Figure 6:
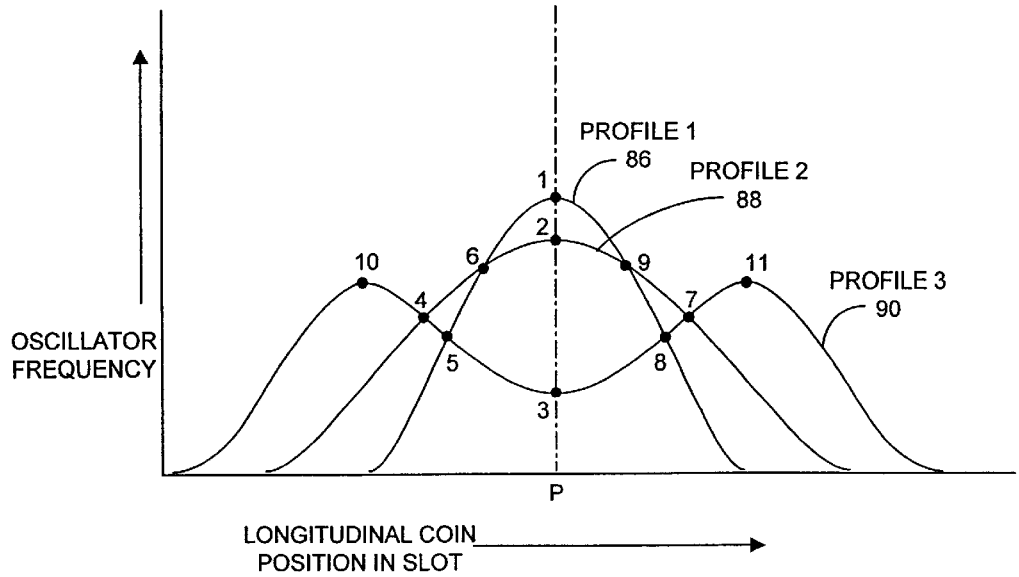
FIG. 6 shows a typical frequency profile of a small coin.

As a coin passes through a set of windings 42, 44, 38, 52, the frequencies of the corresponding oscillators 102, 104, 106, 108 rise and fall in profiles that are characteristic of that particular coin and that set of windings. From these profiles certain "signatures" are extracted to identify the coin. FIG. 5 illustrates typical frequency profiles 80, 82, 84 for a large coin 54, and FIG. 6 illustrates typical frequency profiles 86, 88, 90 for a small coin 56 as it passes through the coin slot 24. While these profiles contain much information, only the information that contributes most directly to coin discrimination is extracted. The simplest points to extract are points 1, 2, and 3 that represent the frequencies when a coin is at a position P, which is the central position of the path of the coin. Point 3 is difficult to recognize alone but may be identified by its positional relationship to the other sampled points. For example, in a method of the preferred embodiment, points 1 and 2 are peak-detected in a software routine, and point 3 is compared against a running minimum/maximum that is stored in the microcontroller 114 memory. Software routines then either determine the slope of the frequency profile 84, 90 near points 1 and 2 and store the appropriate minimum or maximum, or simply decide whether the minimum or maximum of the frequency profile 84, 90 is closer in time to points 1 and 2 and use the appropriate value.

Referring to the set of frequency profiles for a large coin 54 of FIG. 5, the first frequency profile 80 corresponds to the first set of windings 42, 44, the second frequency profile 82 corresponds to the second set of windings 38, and the third frequency profile 84 corresponds to the third set of windings 52. Because the large coin 54 interacts with both coils at a center position P, the frequency profile 84 will display a central peak. In contrast, a third frequency profile 90, for the third set of windings is illustrated in FIG. 6 for a small coin 56. The frequency profile 90 contains two peaks where the small coin 56 interacts more strongly with one or the other half-coils 52. The profile of a small coin 56 exhibits a dip or "valley" when the coin is positioned at center position P along the longitudinal axis 30 between the two coil halves 52. Referring again to FIG. 3*b*, a separation of the half-coils 52 enhances frequency sensitivity to coin diameter and provides a longitudinal scale factor, e.g., the separation between peaks of the frequency profile 90, which is independent of coin velocity.

The preferred embodiment of the present invention utilizes point 1 of the first frequency profile 80, 86, point 2 of the second frequency profile 82, 88, and point 3 of the third frequency profile 84, 90 to identify the vast majority of coins. If the frequencies are designated relative to the natural or "idling" frequencies at points 1, 2, and 3 as F1, F2, and F3, then these points may be used directly as signatures. Although these points are generally sufficient for coin identification, alternate embodiments of the present invention may utilize additional points for coin identification such as crossover points 4 through 9, and peak points 10 and 11. In addition, it is preferable to use ratios, differences or other algebraic combinations of specified points to minimize sensitivity to coin position.

In the preferred embodiment of the present invention, the capacitors used in the LC oscillator circuits 102, 104, 106, 108 are chosen to give natural frequencies in the 10 to 25 MHZ range so that the counter 112 will receive an adequate number of clock cycles in a suitably short time interval. Other embodiments may utilizes either higher or lower frequencies dependent upon the coin sensor 20 configuration. At frequencies in the 10 to 25 MHz range, it is possible to sample all four oscillators sequentially in 1.5 milliseconds or less, during which time a coin traveling at 2 m/s (meters per second) will advance no more than 3 mm. A change in position of 3 mm in the vicinity of sample points 1, 2, and 3, as shown in FIGS. 5 and 6, introduces no significant error even for a coin measuring only 0.650 inches (16.51 mm).

Continuing with FIG. 7, a signature table is stored in non-volatile memory 120. The signature table includes the signatures, as shown in FIGS. 5 and 6, for a statistically significant sampling of coin types and tokens. The signature table includes margins for both the low and high end of each coin signature. For example, the lowest sample values for profile 1 are obtained when a coin is centered in the transverse position, and maximum values are obtained when the coin is positioned at either extreme of the transverse axis. The signature table is scaled to compensate for variations in sensors 20, and is downloaded to each sensor at the time of manufacture. The coin sensor electronics 100 of the preferred embodiment includes a serial input/output port 118 and a bidirectional parallel input/output port 120 that enables the coin sensor to output control signals to an external device, e.g., the vending machine in which it is located. In a version of the sensor that is intended for replacement or retrofit of existing optical coin sensors, the parallel port 120 emulates the hardware behavior of that sensor.

In a preferred method of the present invention, the microcontroller 114 sends sequential enable signals 122, 124, 126, 128 to oscillators 102, 104, 106, 108. As discussed above, each oscillator 102, 104, 106, 108 is enabled during a predetermined time slot. While the coin slot 24 is empty, the microcontroller 114 monitors the idling frequency of each oscillator sent to it by the counter output signal 142 of the counter 112. When a coin is inserted into the coin slot 24 of the coin sensor 20 of FIGS. 1, 2, and 3, the microcontroller 114 detects a change in frequencies of the oscillators 102, 104, 106, 108. The change in frequencies prompts the microcontroller 114 to cease examination of the idling frequencies, and begin to look for the appropriate sample points on each frequency profile. In alternate embodiments, a sensing mechanism (not shown) may be utilized to sense the presence of a coin at the entrance of the coin slot 24 and to send a prompting signal to the microcontroller 114. As the microcontroller 114 identifies each sample point, the sample point is stored in the microcontroller 114 memory for later use. After all points have been sampled, the microcontroller 114 changes its processing state to look for the coin to exit, and calculates a set of sampled signatures from the stored sample points.

Each set of sampled signature is compared to stored signatures for a first coin type in the signature table to determine whether the set of sampled signatures fall within the inclusive boundaries of the first coin type. If any one of the sampled signatures of the set fail the comparison, the microcontroller 114 advances to the next coin type in the signature table. If all three sampled signatures match, the coin has been identified and is processed accordingly. If the set of sampled signatures fail to match any known coin, the microcontroller 114 may opt to either ignore the coin or to report an unknown type, depending on the particular application in which the sensor 20 is used. Once it has been determined that the coin has exited the sensor, the microcontroller 114 returns to monitoring the reference frequencies.

Referring to FIG. 1, in an algorithm of a preferred embodiment of the present invention, a correction factor is calculated based on the difference between sample values for the separated F1 windings 42, 44. This correction factor is divided by a particular constant (one for each frequency) for scaling, and the result is subtracted from the sample to obtain a corrected signature. Given:

$\Sigma$=sum of F1 pair for a given coin at any given transverse position 26;

$\Sigma_c$ =sum of F1 pair when coin is exactly centered in the coin slot 26;

D=difference of F1 pair for a given coin at any given transverse position 26;

F1 is equivalent to $\Sigma$;

F1, F2, and F3 are sample points;

k1, k2, and k3 are constants; and

S1, S2, and S3 are signatures;

Then:

$$S1=\Sigma_c=\Sigma-\Delta^2/k1 \quad \text{Equation 2}$$

$$S2=F2-\Delta^2/k2 \quad \text{Equation 3}$$

$$S3=F3-\Delta^2/k3 \quad \text{Equation 4}$$

While k varies due to both coil geometry and coin parameters, it is possible to approximate the value of k closely enough to minimize the spread in signatures due to coin trajectory 32. It should also be apparent that the compensation equations may be altered to accommodate design modifications without departing from the spirit of these claims.

The coin sensor 20 of the preferred embodiment contains software routines that provide extensive diagnostic capability. All oscillator frequencies and input /output functions of the coin sensor components 100 can be measured and reported to automated test equipment. A serial number is provided for each coin sensor 20 for tracking and identification purposes. A part number is provided for each coin sensor 20 for configuration control purposes. Each coin sensor 20 may be queried to report such information, which is stored in non-volatile memory 120. Secure functions such as serial number entry or signature table download require a security procedure to be performed prior to acceptance.

Other embodiments and modifications of the present invention will occur readily to those of ordinary skill in the art in view of these teachings. Such persons will appreciate the symmetries among the various embodiments illustrated above and understand that their elements may be arranged in other ways to produce similar results. Therefore, this invention is to be limited only by the following claims, which include all such other embodiments and modifications when viewed in conjunction with the above specification and accompanying drawings.

We claim:

1. A coin sensor for identifying a coin having a facial area, a thickness, and a diameter, the coin sensor comprising:

a coin slot for accepting the coin and providing a path for the coin to travel through the sensor;

at least three oscillators, each oscillator of the at least three oscillators having a natural frequency;

at least three sets of windings, each set of windings corresponding to one of the at least three oscillators, the at least three sets of windings positioned symmetrically above and below the coin slot, the at least three sets of windings comprising:

a first set of windings corresponding to a first oscillator for producing a first magnetic field having flux lines substantially perpendicular to a face of the coin as it travels through the coin slot along the path, wherein the coin traveling through the first set of windings produces a change in the natural frequency of the first oscillator that is characteristic of the facial area of the coin;

a second set of windings corresponding to a second oscillator for producing a second magnetic field having flux lines substantially parallel to a face of the coin as it travels through the coin slot, wherein the coin traveling through the second set of windings produces a change in the natural frequency of the second oscillator that is characteristic of the thickness of the coin; and a third set of windings corresponding to a third oscillator for producing a third magnetic field having flux lines substantially perpendicular to the face of the coin, wherein the coin traveling through the third set of windings produces a change in the natural frequency of the third oscillator that is characteristic of the diameter of the coin; and a microcontroller circuit comprising:

means for sequentially enabling the at least three oscillators;

means for measuring the changes in the natural frequencies of the at least three oscillators for a plurality of coin positions as the coin travels through the coin slot;

means for utilizing the measured changes for producing at least three profiles comprising a first profile corresponding to the first set of windings, a second profile corresponding to the second set of windings, and a third profile corresponding to the third set of windings;

means for determining a coin signature comprising at least one frequency point of each of the first, second and third profiles; and means for comparing the coin signature to a plurality of pre-stored signatures of a plurality of valid coins.

2. The coin sensor of claim 1, wherein the at least three oscillators are inductive/capacitive (LC) oscillators.

3. The coin sensor of claim 1, wherein the first set of windings comprises a first half winding positioned above the coin slot and a second half winding positioned below the coin slot, and wherein the first profile is generated by the combination of samples from two oscillators for separately driving the first and second half windings.

4. The coin sensor of claim 1, wherein the third set of windings comprises a first half coil and a second half coil that are separated longitudinally in a direction of the path.

5. The coin sensor of claim 1, wherein the means for measuring the change in the natural frequencies of the at least three oscillators comprises a counter.

6. The coin sensor of claim 5, wherein the counter is connected to each of the at least three oscillators for a pre-determined duration in a pre-determined sequence.

7. The coin sensor of claim 5, wherein the oscillators are enabled sequentially utilizing enable lines controlled by the microcontroller, and wherein the outputs of the oscillators are multiplexed to the counter via a multiplexer controlled by the microcontroller.

8. The coin sensor of claim 1, wherein the pre-stored signatures include a range of values to compensate for variations in one or more of a lateral, transverse and longitudinal position of the coin as it travels through the coin slot.

9. The coin sensor of claim 1, wherein the at least three sets of windings are implemented using traces on a pair of matched complementary printed circuit boards that are placed above and below the coin slot.

10. A method of identifying a coin utilizing a coin sensor having a plurality of oscillators, the method comprising:

a. providing a coin slot for accepting a coin, the coin slot providing a path for the coin through the coin sensor;

b. enabling a first oscillator of the plurality of oscillators during a first time slot, measuring and storing a change in a natural frequency of the first oscillator as the coin travels along the path through a magnetic field generated by the first oscillator, and disabling the first oscillator;

c. enabling a second oscillator of the plurality of oscillators during a second time slot, measuring and storing a change in a natural frequency of the second oscillator as the coin travels along the path through a magnetic field generated by the second oscillator, and disabling the second oscillator;

d. enabling a third oscillator of the plurality of oscillators during a third time slot, measuring and storing a change in a natural frequency of the third oscillator as the coin travels along the path through a magnetic field generated by the third oscillator, and disabling the third oscillator;

e. repeating step b. through d. until the coin exits the path;

f. producing a frequency profile from the stored measured changes for each of the plurality of oscillators;

g. producing a signature comprising at least one frequency point of each of the frequency profiles for the plurality of oscillators;

h. comparing the signature with a plurality of pre-stored signatures; and i. outputting a control signal indicating either a match of the signature with one of the plurality of pre-stored signatures or a mismatch with each of the plurality of pre-stored signatures.

11. The method of claim 10, wherein the change in natural frequency of the first oscillator is indicative of a facial area of the coin.

12. The method of claim 10, wherein a change in natural frequency of the second oscillator is indicative of a cross-sectional thickness of the coin.

13. The method of claim 10, wherein a change in natural frequency of the third oscillator is indicative of a diameter of a coin.

14. The method of claim 13, wherein the third oscillator produces two magnetic fields that are separated longitudinally along the path.

15. The method of claim 10, wherein the first oscillator comprises a first winding oscillator for driving a first half winding located above the coin slot and a second winding oscillator for driving a second half winding located below the coin slot.

16. The method of claim 15, further comprising the step of summing the measured changes of the first winding oscillator and the second winding oscillator to provide a combined measured change.

17. The method of claim 15, further comprising the steps of determining a difference between the measured changes of the first winding oscillator and the second winding oscillator;

determining a transverse coin position of the coin along a transverse axis of the path based upon the difference, and calculating a compensation factor utilizing the transverse coin position, the compensation factor for effectively normalizing a position of the coin to a center of the transverse axis.

18. The method of claim 15, further comprising the step of subtracting the measured changes of the first winding oscillator and the second winding oscillator to provide an indication of a transverse position of the coin in the coin slot.

19. An inductive/capacitive (LC) coin sensor having a coin slot for accepting a coin, the LC coin sensor comprising:

a first oscillator for driving a first set of windings, the first set of windings positioned above the coin slot to produce a magnetic field having flux lines that are substantially perpendicular to a first face of the coin, the first oscillator having a first natural frequency;

a second oscillator for driving a second set of windings, the second set of windings positioned below the coin slot to produce a magnetic field having flux lines that are substantially perpendicular to a second face of the coin, the second oscillator having a second natural frequency;

a third oscillator for driving a third set of windings, the third set of windings for producing a magnetic field having flux lines that are substantially parallel to the first and second faces of the coin, the third oscillator having a third natural frequency;

a fourth oscillator for driving a fourth set of windings, the fourth set of windings comprising a first half winding and a second half winding separated along a longitudinal axis of the coin slot, the first and second half windings producing magnetic fields having flux lines that are substantially perpendicular to the first and second faces of the coin, the fourth oscillator having a fourth natural frequency;

a counter for measuring a change in the natural frequencies for each of the first, second, third and fourth oscillators during pre-determined time slots, wherein the change in the natural frequencies is due to the presence of the coin in the magnetic fields of the first, second, third and fourth oscillators;

a microcontroller for enabling the first, second, third, and fourth oscillators in a sequence during the pre-determined time slots, the microcontroller repeating the sequence until the coin exists the coin slot, the microcontroller having means for producing a signature for the coin from the changes in natural frequencies and for comparing the signature to a plurality of pre-stored signatures;

a memory for storing the pre-stored signatures; and at least one input/output port for communicating a result of the comparison.

20. A method of identifying a coin in a coin slot, comprising the steps of:

determining a transverse position of the coin in the coin slot, comprising the steps of:

providing a first set of windings above the coin slot and substantially parallel to a first face of the coin, the first set of windings driven by a first oscillator having a first natural frequency;

providing a second set of windings below the coin slot and substantially parallel to a second face of the coin, the second set of windings driven by a second oscillator having a second natural frequency, wherein the second set of windings is aligned in parallel with first set of windings;

measuring a change in the first natural frequency of the first oscillator as the coin travels through a magnetic field generated by the first oscillator;

measuring a change in the second natural frequency of the second oscillator as the coin travels through a magnetic field generated by the second oscillator; and determining a difference between the change in the first natural frequency and the change in the second natural frequency;

wherein the difference provides an indication of the transverse position of the coin in the coin slot; and utilizing the transverse position, the change in the first natural frequency and the change in the second natural frequency to identify the coin.

21. The method of identifying a coin in a coin slot as in claim 20, wherein the first natural frequency is substantially equal to the second natural frequency.

* * * * *

UNITED STATES PATENT AND TRADEMARK OFFICE

CERTIFICATE OF CORRECTION

PATENT NO. : 6,739,444 B2
DATED : May 25, 2004
INVENTOR(S) : Kevin R. Baker and Kent Erickson It is certified that error appears in the above-identified patent and that said Letters Patent is hereby corrected as shown below:

Title page,
Insert Item -- [73] Assignee: Cubic Corporation, San Diego, CA (US) --

Signed and Sealed this

Nineteenth Day of April, 2005

JON W. DUDAS
*Director of the United States Patent and Trademark Office*